US005952163A

United States Patent [19]

Baugher et al.

[11] Patent Number: 5,952,163

[45] Date of Patent: Sep. 14, 1999

[54] DIRECT DENTAL X-RAY FILMS ADAPTED FOR ROOM LIGHT HANDLING

[75] Inventors: Jeffrey S. Baugher, Rochester; Robert E. Dickerson, Hamlin; Alan S. Fitterman, Rochester, all of N.Y.

[73] Assignee: Eastman Kodak Company, Rochester, N.Y.

[21] Appl. No.: 09/007,085

[22] Filed: Jan. 14, 1998

[51] Int. Cl.[6] ..... G03C 1/46

[52] U.S. Cl. ..... 430/502; 430/517; 430/522; 430/603; 430/606; 430/966

[58] Field of Search ..... 430/966, 603, 430/502, 517, 522, 606

[56] References Cited

U.S. PATENT DOCUMENTS

| | | | |
|---|---|---|---|
| 2,379,373 | 6/1945 | Murray | 430/513 |
| 2,542,304 | 2/1951 | Boucher | 430/495.1 |
| 3,963,497 | 6/1976 | Kosti | 430/522 |
| 4,803,150 | 2/1989 | Dickerson et al. | 430/502 |
| 4,900,652 | 2/1990 | Dickerson et al. | 430/502 |
| 4,994,355 | 2/1991 | Dickerson et al. | 430/509 |
| 4,997,750 | 3/1991 | Dickerson et al. | 430/509 |
| 5,021,327 | 6/1991 | Bunch et al. | 430/496 |
| 5,098,818 | 3/1992 | Ito et al. | 430/522 |
| 5,108,881 | 4/1992 | Dickerson et al. | 430/502 |
| 5,370,977 | 12/1994 | Zietlow | 430/502 |
| 5,399,470 | 3/1995 | Dickerson et al. | 430/509 |

*Primary Examiner*—Janet Baxter
*Assistant Examiner*—Amanda C. Walke
*Attorney, Agent, or Firm*—Carl O. Thomas

[57] ABSTRACT

A direct X-ray dental film is disclosed that, following imagewise exposure, can be removed from its opaque package and processed in room light. The film is comprised of emulsion and protective layers that contain dye particles which can be decolorized during processing. The dye particles provide an average density of greater than 3.0 over a spectral range of above 320 nm over which the silver halide exhibits an absorption coefficient of at least 0.5 $cm^{-1}$. For additional protection the emulsion layers contain desensitizer adsorbed to the silver halide grains to reduce their sensitivity to light without significantly reducing their sensitivity to X-radiation.

8 Claims, No Drawings

DIRECT DENTAL X-RAY FILMS ADAPTED FOR ROOM LIGHT HANDLING

FIELD OF THE INVENTION

The invention relates to silver halide radiographic elements particularly adapted for use in dental diagnostic imaging.

BACKGROUND

Medical diagnostic imaging employing silver halide emulsions for X-radiation imaging can be divided into two categories: (1) direct X-ray imaging and (2) indirect X-ray imaging.

In the first approach a radiographic element is constructed with a silver halide emulsion layer coated on a support. The ability of the silver halide grains to absorb X-radiation during exposure is relied upon for imaging. When a single emulsion layer is employed for X-radiation capture, only about 1 percent of the exposing radiation is absorbed. The absorption can be doubled by coating two emulsion layers, one on each major face of a film support. Such elements are term "dual-coated" and are sold by the Eastman Kodak Company under the trademark "Duplitized".

In the second approach an intensifying screen is used in conjunction with a silver halide emulsion layer. The intensifying screen captures X-radiation and emits light that is used to imagewise expose the emulsion layer. The ability of the emulsion to absorb light is about 20 times greater than its ability to absorb X-radiation. Hence patient dosage is markedly reduced. Dual-coated radiographic elements intended for indirect exposure minimize patient exposure to X-radiation and serve the majority of medical diagnostic applications.

One of the problems encountered with dual-coated indirect X-ray films occurs when light emitted by an intensifying screen on one side of a transparent film support inadvertently crosses over to expose the emulsion layer on the opposite side of the support. The problem of crossover results in reduced image sharpness. This problem can be eliminated by adding to dual-coated radiographic elements crossover control layers between the emulsion layers and the support. Reduced crossover dual-coated indirect X-ray films are disclosed by Dickerson et al U.S. Pat. Nos. 4,803,150, 4,900,652, 4,994,355, 4,997,750, 5,021,327, 5,108,881 and 5,399,470.

Dental diagnostic imaging conventionally employs dual-coated direct X-ray films. Nothing akin to the crossover problem observed in indirect X-ray films is observed. During X-ray exposure no light is generated. Due to its high energy level, the X-radiation is either absorbed or passes straight through the element and hence the type of image unsharpness generated by light crossover is entirely avoided. Zietlow U.S. Pat. No. 5,370,977 illustrates a modern direct X-ray film construction.

In dental diagnostic imaging the area of a single exposure is small. A small piece of X-ray film, commonly referred to as a "chip", mounted in a sealed opaque package, is placed in the patient's mouth during X-ray exposure. The oral location of the film during exposure renders the use of intensifying screens difficult and, when the small area of exposure and therefore small benefit to be gained is taken into account, impractical. Following exposure, the dentist or dental technician retreats to a separate room equipped with safelights to remove the dental film chip from its opaque package and complete processing to a viewable image.

Attempts to integrate light exposure protection into direct X-ray films are known, but have not been accepted. For example, Murray U.S. Pat. No. 2,379,373 discloses overcoating the emulsion layers of direct X-ray films with carbon black in a casein and gelatin vehicle that can be removed during processing. Boucher U.S. Pat. No. 2,542,304 discloses laminating strippable opaque layers over the surface of the emulsion layers in direct X-ray films.

SUMMARY OF THE INVENTION

This invention has as its purpose to provide a direct X-ray dental film that can be processed in room light. This allows the dentist or dental technician to remove the exposed film chip in its opaque package from the patient's mouth, remove the film chip from the package, and process the film chip without ever leaving the patient. This has the capability of streamlining dental practice into a more time-efficient continuum, with intervals in which the patient is asked to wait unattended being minimized. The present invention specifically contemplates a less obtrusive integration of X-ray imaging into dental practice, even allowing interim images to be obtained and viewed during the course of completing a dental procedure. The present invention incurs no penalty in terms of X-ray imaging speed.

In one aspect, this invention is directed to a direct X-ray dental film comprised of a transparent film support having first and second major faces and, coated on the major faces, processing solution permeable hydrophilic colloid layer units including emulsion layers comprised of silver halide grains containing less than 3 mole percent iodide, based on silver, and protective layers coated over the emulsion layers, wherein a desensitizer is adsorbed to the silver halide grains to reduce their sensitivity to light without significantly reducing their sensitivity to X-radiation and the emulsion and protective layers contain dye particles which can be decolorized during processing, the dye particles being present in an amount sufficient to provide an average density of greater than 3.0 over a spectral range of above 320 nm over which the silver halide exhibits an absorption coefficient of at least 0.5 $cm^{-1}$, from 15 to 40 percent of the dye particles being present in the emulsion layers and from 60 to 85 percent of the dye particles being present in the protective layers.

DESCRIPTION OF PREFERRED EMBODIMENTS

In a simple form the direct X-ray dental film of the invention can take the following form:

| DXR-1 |
|---|
| Protective Overcoat |
| Emulsion Layer |
| Transparent Film Support |
| Emulsion Layer |
| Protective Overcoat |

The transparent film support can take any convenient conventional form. In its simplest possible form the transparent film support consists of a transparent film chosen to allow direct adhesion of the hydrophilic colloid emulsion layers. More commonly, the transparent film is itself hydrophobic and subbing layers are coated on the film to facilitate adhesion of the hydrophilic emulsion layers. Typically the support is either colorless or blue tinted, tinting dye being present in one or both of the film and the subbing layers. Any of the transparent photographic film supports can be employed disclosed in *Research Disclosure,* Vol. 389, September 1996, Item 38957, Section XV. Supports, particularly paragraph (2), which describes subbing layers, and paragraph (7), which describes preferred polyester film supports. *Research Disclosure* is published by Kenneth Mason Publications, Ltd., Dudley House, 12 North St., Emsworth, Hampshire P010 7DQ, England. Conventional radiographic film supports, including blue tinting dyes, are described in *Research Disclosure,* Vol. 184, August 1979, Item 18431, XII. Film Supports.

The emulsion layers contain silver halide grains containing less than 3 mole percent iodide, based on silver, in a hydrophilic colloid dispersing medium, which taken together form an emulsion. Silver halide grain compositions contemplated include silver bromide, silver iodobromide, silver chlorobromide, silver iodochlorobromide, silver chloroiodobromide, silver chloride, silver iodochloride, silver bromochloride and silver iodobromochloride, where halides are named in order of ascending concentrations. Iodide is limited to facilitate more rapid processing. Preferably iodide is limited to less than 1 mole percent, based on silver, or eliminated entirely from the grains.

The silver halide grain coating coverages are chosen to provide an overall maximum density of at least 3.5 and preferably at least 4.0 following imagewise exposure and processing. Depending upon the specific type of emulsion chosen and the presence or absence of covering power enhancing components, silver coating coverages in each emulsion layer, assuming identical emulsion layers on opposite sides of the support, can range from 5.0 to 30 g/m$^2$, but more typically range from 7.5 to 25 g/m$^2$.

The silver halide emulsions can take the form of either tabular or nontabular grain emulsions, where a tabular grain emulsion is defined as one in which tabular grains account for greater than 50 percent of total grain projected area. Conventional emulsions in use in radiographic elements prior to the use of tabular grain emulsions are disclosed in *Research Disclosure,* Item 18431, cited above, and include singlejet emulsions and continuously precipitated double-jet emulsions, ammoniacal emulsions, and thiocyanate or thioether ripened emulsions.

Preferred emulsions are tabular grain emulsions. The following, here incorporated by reference, are representative of conventional tabular grain emulsions of the varied halide compositions set out above:

| | |
|---|---|
| Wilgus et al | U.S. Patent 4,434,226; |
| Kofron et al | U.S. Patent 4,439,520; |
| Wey et al | U.S. Patent 4,414,306; |
| Maskasky | U.S. Patent 4,713,320; |
| Maskasky | U.S. Patent 4,713,323; |
| Saitou et al | U.S. Patent 4,797,354; |
| Tsaur et al | U.S. Patent 5,147,771; |
| Tsaur et al | U.S. Patent 5,147,772; |
| Tsaur et al | U.S. Patent 5,147,773; |
| Tsaur et al | U.S. Patent 5,171,659; |
| Maskasky et al | U.S. Patent 5,176,992; |
| Maskasky | U.S. Patent 5,178,997; |
| Maskasky | U.S. Patent 5,178,998; |
| Maskasky | U.S. Patent 5,183,732; |
| Maskasky | U.S. Patent 5,185,239; |
| Tsaur et al | U.S. Patent 5,210,013; |
| Tsaur et al | U.S. Patent 5,221,602; |
| Tsaur et al | U.S. Patent 5,252,453; |
| Maskasky | U.S. Patent 5,264,337; |
| Maskasky | U.S. Patent 5,292,632; |
| House et al | U.S. Patent 5,320,938; |
| Maskasky | U.S. Patent 5,399,478; |
| Maskasky | U.S. Patent 5,411,852. |

Preferred tabular grain emulsion selections for use in the emulsion layers are those disclosed by Zietlow U.S. Pat. No. 5,370,977, the disclosure of which is here incorporated by reference. Tabular grains are recognized to provide superior covering power (Dmax÷silver coating coverage). It is therefore preferred to employ tabular grain emulsions in which tabular grains account for at least 75 (and optimally at least 90) percent of total grain projected area. Tabular grain emulsions have been reported in which substantially all (>98% of total grain projected area) of the grains are tabular.

Tabular grain emulsions are known to be useful in mean equivalent circular diameter (ECD) sizes of up to 10 $\mu$m. For dental imaging, the maximum average ECD is halved in the interest of reducing granularity (image noise). Further, it is preferred that the maximum average ECD of the tabular grains be less than 3.0 $\mu$m.

Limiting the average ECD of the tabular grains and their thickness, reduces the silver content per grain. This allows the number of grains for a given silver coating coverage to be increased, which translates into reduced granularity. It is contemplated to employ tabular grains that exhibit average thicknesses of less than 0.3 $\mu$m and preferably less than 0.2 $\mu$m. Ultrathin (<0.07 $\mu$m in average thickness) tabular grain emulsions are known and can be employed, but, to avoid warm image tones, it is preferred that the tabular grains have an average thickness of at least 0.1 $\mu$m.

The tabular grains preferably exhibit at least an intermediate average aspect ratio (i.e., an average aspect ratio of at least 5). Average aspect ratio (AR) is the quotient of average ECD divided by average tabular grain thickness (t):

$$AR=ECD\div t$$

High (>8) average aspect ratios ranging up to 50 or more are preferred. Optimum average aspect ratios are in the range of from 10 to 35.

The tabular grain emulsions employed in the dental films of the invention are chemically sensitized. Noble metal (e.g., gold) and middle chalcogen (i.e., sulfur, selenium and tellurium) chemical sensitizers can be used individually or in combination. Selected site silver salt epitaxial sensitization as taught by Maskasky U.S. Pat. No. 4,435,501 is also contemplated. Conventional chemical sensitizers are disclosed in *Research Disclosure,* Item 38957, cited above, Section IV. Chemical sensitization.

Other conventional features of preferred emulsion layers of the dental films of the invention are disclosed both in Item 38957, cited above, which is directed to silver halide emulsion technology generally, and in Item 18431, cited above, the disclosure of which is directed specifically to radiographic elements. The emulsion grains can be internally doped as disclosed in Item 38957, Section I, sub-section D, and Item 18431, Section I, sub-section C. The emulsions can contain antifoggants and stabilizers, as disclosed in Item 38957, Section VII, and Item 18431, Section II.

A general description of vehicles and vehicle extenders and hardeners for the emulsion and protective overcoat layers of the dental films are disclosed by Item 38957, Section II. Gelatin (including gelatin derivatives, such as acetylated gelatin and phthalated gelatin) constitute preferred grain peptizers and hydrophilic colloid layer vehicles.

The use of cationic starch as peptizers for tabular grain emulsions is taught by Maskasky U.S. Pat. Nos. 5,620,840 and 5,667,955.

Since the dental films are intended to be exposed by the direct absorption of X-radiation, spectral sensitization of the emulsions serves no useful purpose. However, to avoid fogging the film with inadvertent light exposure, it is specifically contemplated to incorporate a "desensitizer" in the emulsions. The term "desensitizer" is employed in its ordinary photographic usage to indicate a material that reduces the sensitivity of an emulsion to light exposures. Conventional desensitizers employed in photography and, occasionally, in indirect radiography do not reduce the absorption of X-radiation and hence do not reduce the sensitivity of the emulsions to X-radiation exposures. Conventional desensitizers that are not dyes are disclosed in *Research Disclosure,* Item 38957, Section IV, sub-section B. These desensitizers are illustrated by N,N'-dialkyl-4,4'-bispyridinium salts, nitron and its salts, thiruam disulfide, piazine, intro-1,2,3-benzothiazole, nitroindazole and 5-mercaptotetrazole, disclosed by Peterson et al U.S. Pat. No. 2,271,229, Kendall et al U.S. Pat. No. 2,541,472, Abbott et al U.S. Pat. No. 3,295,976, Rees et al U.S. Pat. Nos. 3,184,313 and 3,403,025, Biggons et al U.S. Pat. No. 3,922,545, Sumi et al U.S. Pat. No. 4,666,827 and Uesawa et al U.S. Pat. No. 4,840,889, the disclosures of which are here incorporated by reference.

It is also possible to employ as a desensitizer a methine dye, such as a cyanine or merocyanine dye, having one or more desensitizing nuclei. Typical heterocyclic nuclei featured in cyanine and merocyanine dyes well-suited for use as desensitizers are derived from nitrobenzothiazole, 2-aryl-1-alkylindole, pyrrolo[2,3-b]pyridine, imidazo[4,5-b]quinoxaline, carbazole, pyrazole, 5-nitro-3H-indole, 2-arylbenzindole, 2-aryl-1,8-trimethyleneindole, 2-heterocyclylindole, pyrylium, benzopyrylium, thiapyrylium, 2-amino-4-aryl-5-thiazole, 2-pyrrole, 2-(nitroaryl)indole, imidazo[1,2-a]pyridine, imidazo[2,1-b]thiazole, imidazo[2,1-b]-1,3,4-thiadiazole, imidazo[1,2-b]pyridazine, imidazo[4,5-b]quinoxaline, pyrrolo[2,3-b]quinoxaline, pyrrolo[2,3-b]pyrazine, 1,2-diarylindole, 1-cyclohexylpyrrole and nitrobenzoselenazole. Such nuclei can be further enhanced as desensitizers by electron-withdrawing substituents such as nitro, acetyl, benzoyl, sulfonyl, benzosulfonyl and cyano groups. Desensitizing dyes containing nuclei of these types are illustrated by Kendall U.S. Pat. No. 2,293,261, Coenen et al U.S. Pat. No. 2,930,694, Brooker et al U.S. Pat. No. 3,431,111, Mee et al U.S. Pat. Nos. 3,492,123, 3,501,312 and 3,598,595, Illingsworth et al U.S. Pat. No. 3,501,310, Lincoln et al U.S. Pat. No. 3,501,311, VanLare U.S. Pat. No. 3,615,608, Carpenter et al U.S. Pat. No. 3,615,639, Riester et al U.S. Pat. No. 3,567,456, Jenkins U.S. Pat. No. 3,574,629, Jones U.S. Pat. No. 3,579,345, Mee U.S. Pat. No. 3,582,343, Fumia et al U.S. Pat. No. 3,592,653 and Chapman U.S. Pat. No. 3,598,596.

The protective overcoat overlying each emulsion layer is comprised of a hydrophilic colloid vehicle, chosen from among the same types disclosed above in connection with the emulsion layers. In conventional radiographic elements protective overcoats are provided to perform two basic reasons: First, to provide a layer between the emulsion layer and the surface of the element for physical protection of the emulsion layer during handling and processing. Second to provide a convenient location for the placement of addenda, particularly those that are intended to modify the physical properties of the radiographic element. The protective overcoats of the dental films of this invention can perform both these basic functions. The protective overcoats can include the features disclosed by *Research Disclosure,* Item 18431, cited above, IV. Overcoat Layers, and can also include addenda (including coating aids, plasticizers and lubricants, antistats and matting agents) disclosed by *Research Disclosure,* Item 38957, IX. Coating physical property modifying addenda.

In addition to these conventional features the protective overcoats also include processing solution decolorizable dye particles. The function of the dye particles is to intercept light that would otherwise fog the emulsion when the imagewise exposed dental film is, following imagewise exposure, handled in room in the interval between removal from the opaque package and processing. The dye is incorporated in a particulate form to keep it from wandering (diffusing) during coating. Thus, the dye placed in the protective overcoat is assured of remaining in this location.

The function of the particulate dye in the protective overcoat is to intercept light so that it does not reach the emulsion layers. If the particulate dye remained in the dental film unaltered following processing, it would, of course, intercept the light that must be transmitted through the dental film chip to allow the image to be viewed. Therefore, the particulate dye must have the added capability of being decolorized during processing.

Both the light intercepting and decolorizing functions that the dye particles must perform are most efficiently realized when the average dye particle size is limited. In all instances the average ECD of the dye particles is less than 10 $\mu$m. The average ECD of the dye particles is preferably less than 1 $\mu$m and can conveniently range down to about 0.01 $\mu$m. Conventional particle sizing techniques can be employed to obtain dye particles in the size ranges contemplated.

James *The Theory of the Photographic Process,* 4th Ed., Macmillan, New York, 1977, FIG. 1.16, p. 39, discloses the absorption coefficient of silver halides of varied compositions over the spectral region of from 220 to 580 nm. In the dental films of the invention light absorption of the hydrophilic colloid vehicle at wavelengths of 320 nm and shorter protects the silver halide grains from unwanted light exposure. For silver chloride grains this leaves an "at risk" spectral range of from 320 to 420 nm in which its absorption coefficient exceeds 0.5 $cm^{-1}$ (i.e., it exhibits significant light absorption) and the silver chloride grains receive no significant protection from light exposure by the hydrophilic colloid vehicle. For silver bromide the corresponding at risk spectral range is from 320 to 450 nm. For silver iodobromide containing 3 mole percent iodide, based on silver, the corresponding at risk spectral range is from 320 to 540 nm.

One or a combination of particulate dyes is chosen to absorb light in the at risk spectral region above 320 nm over which the silver halide grains exhibit an absorption coefficient of greater than 0.5 $cm^{-1}$. Particulate dyes satisfying the absorption and process solution decolorizing criteria can be selected from among conventional dyes employed as absorbing materials in photographic elements. Such conventional dyes and processes for their decolorization (discharge) are generally disclosed in *Research Disclosure,* Item 38757, cited above, Section VIII. Absorbing and scattering materials, B. Absorbing materials. Specific examples of processing solution decolorizable particulate dyes useful in the practice of this invention are provided by Diehl et al U.S. Pat. Nos. 4,092,168, 4,940,654, 4,950,586, 4,994,356 and 5,213,956, Factor et al U.S. Pat. Nos. 4,900,653 and 4,948,718, Anderson et al U.S. Pat. No. 4,988,611, Usagawa et al U.S. Pat. No. 5,208,137, Adachi U.S. Pat. No. 5,213,957 and Usami U.S. Pat. No. 5,238,798, the disclosures of which are here incorporated by reference.

A preferred class of processing solution decolorizable particulate dyes are those that satisfy the formula:

(I)

$$D\text{-}[(A)_y\text{-}X_n]_m$$

wherein

A is an aromatic ring bounded directly to D;

D is a dye chromophore forming moiety, which must include an aromatic ring when y is zero;

m is 1 or 2;

n is 1 to 3;

X is a substituent containing an ionizable proton, either on A or on an aromatic ring portion of D, having a pKa of 4 to 11 in an equal volume mixture of ethanol and water; and y is 0 to 4.

In one preferred form D includes a pyrazolin-5-one nucleus and y is 0. In a specifically preferred form D completes the chromophore of an oxonol dye (preferably containing two pyrazolin-5-one nuclei joined at their 2 ring position by a methine linkage, y is 0, and m is 2.

Although it would be thought that locating the particulate dyes entirely in the protective overcoats would be the ideal location for the dyes to minimize emulsion exposure in the at risk spectral region, it has been observed that protection of the dental films from the image degrading effects of light exposure is improved by incorporating a portion of the particulate dye in the emulsion layer. However, placing all of the particulate dye in the emulsion layer produces an even worse effect than placing all of the dye in the protective layer.

Thus, it is specific feature of this invention that the particulate dye is in part incorporated in the protective overcoats and in part in the emulsion layers. A major part, preferably from 60 to 85 percent of the total particulate dye, is incorporated in the protective overcoats while a minor part, preferably from 15 to 40 percent of the total particulate dye, is incorporated in the emulsion layers.

The total amount of particulate dye employed is that which is required to provide an average density of greater than 3.0 over the at risk spectral region—that is, the spectral region starting at wavelengths longer than 320 nm to the wavelength at which the absorption coefficient of the silver halide grains employed for imaging in the emulsion layers drops below 0.5 $cm^{-1}$. At a density of 3.0 only 0.1 percent of the light incident upon the dental film is transmitted through it. Since dyes do not generally exhibit uniform levels of absorption over extended spectral ranges, it is appreciated that the absorption of the dye or dye mixture can vary in magnitude across the at risk spectral region. Incorporating higher than the minimum indicated levels of particulate dye has no adverse impact on imaging speed. Since room light exhibits a wide distribution of wavelengths, a deficiency dye absorption over a restricted spectral range is not detrimental, provided the overall average of densities over the at risk spectral region remains above 3.0.

Although the particulate dye coating coverages can be expected to vary, depending upon the bandwidth of the at risk spectral region (i.e., the choice of silver halides) and the extinction coefficients of the dyes employed and their half-peak bandwidths, it is contemplated that particulate dye coating coverages will typically be less than 2.0 $g/m^2$, preferably less than 1.5 $g/m^2$. Particulate dye coating coverages are typically at least 0.5 $g/m^2$ and are most commonly at least 0.7 $g/m^2$.

The coating coverages of the hydrophilic colloids in the emulsion and protective overcoat layers can be varied widely. The minimum level of hydrophilic colloid is that required to assure coating uniformity. Hydrophilic colloid coating coverages that are at least 50 percent by weight of the total particulates coated are adequate to assure coating uniformity. In the emulsion layer the total required particles consist of the silver halide grains employed for imaging and the particulate dye. In the protective overcoat the particulate dye constitutes the only required particles. However, commonly matting beads are also incorporated in the protective overcoat. Increasing the ratio of hydrophilic colloid to particles in the protective overcoat and emulsion layers does not adversely affect imaging properties, but can have the effect of increasing processing times. It is therefore usually preferred to limit the weight ratio of hydrophilic colloid to particles in each layer to 2:1 or less. Typically the total thickness of the hydrophilic colloid layers on each side of the support ranges from about 3 to 7 $\mu$m, most typically from about 4 to 6 $\mu$m.

In the simple dental film DXR-1 described above a single protective layer and a single emulsion layer form a hydrophilic colloid layer unit coated on each major face of the film support, and the dental film is symmetrical—this, the layer units on opposite sides of the support are identical. It is recognized that asymmetrical film constructions are known and contemplated, but for most applications add unnecessary complexity to film construction and use without offsetting advantages. Either or both of the protective overcoat and the emulsion layer in each of the layer units can be partitioned into two or more separate coatings. Any convenient partitioning can be undertaken, provided that the partitioned coating satisfies the overall requirements of a single coating described above. For example, it is common practice to divide a protective overcoat into separate surface overcoat and interlayer coatings. The interlayer serves to isolate the emulsion layer from addenda in the surface overcoat. Similarly, emulsion layers are often divided to allow different selections of silver halide emulsions or emulsion addenda in the separate layers.

Exposure and processing of the dental films of the invention can be undertaken in any convenient conventional manner. The exposure and processing techniques of Zietlow U.S. Pat. No. 5,370,977, cited and incorporated by reference above, are typical.

EXAMPLES

The invention can be better appreciated by reference to the following specific embodiments. All coating coverages shown in parenthesis are in units of $g/m^2$, except as otherwise indicated. Coating coverages of silver halide are reported in terms of silver.

A series of films were constructed having the layer configuration of DXR-1.

Control Film A

Each Protective Overcoat:

| | |
|---|---|
| Gelatin | (1.35) |

Each Emulsion Layer: AgBr tabular grain emulsion in which tabular grains accounted for greater than 50 percent of total grain projected area. The mean grain ECD was 1.3 $\mu$m and the mean thickness of the tabular grains was 0.13 $\mu$m. The BWM latex polymer was poly(n-butyl acrylate-co-isopropylmethacrylamide-co-methylacrylamide). The APMT was 1-(3-acetamidophenyl)-5-mercaptotetrazole. The TAI was 4-hydroxy-6-methyl-1,3,3a,7-tetraazaindene. The MeS-TAI was 4-hydroxy-6-methyl-2-methylmercapto-1,3,3a,7-tetraazaindene.

| | |
|---|---|
| AgBr | (7.56) |
| Gelatin | (4.9) |
| BWM latex polymer | (1.84) |
| Dextran | (1.51) |
| APMT | (0.031) |
| Nitron | (0.007) |
| Sorbitol | (0.06) |
| TAI | 2.1 g/Ag mole |
| 6-Chloro-4-nitrobenzotriazole | (0.02) |
| Catechol disulfide | (0.25) |
| Maleic acid hydrazide | (0.004) |
| MeS-TAI | 400 mg/Ag mole |
| 2-Mercaptobenzotriazole | (3.0) |

Transparent Film Support: A blue tinted poly(ethylene terephthalate) film having a 178 $\mu$m thickness and coated with conventional subbing layers. The Protective Overcoat and Emulsion Layers were both hardened by adding to each Emulsion Layer bis(vinylulfonylmethyl)ether hardener in a concentration of 2.4 percent by weight, based on the gelatin in both the Emulsion Layer and the Protective Overcoat.

Control Film B

This film was identical to Control Film A, except that the following dyes were added to each Emulsion Layer:

| | |
|---|---|
| Dye I | (0.16) |
| Dye II | (0.11) |

Dye I was bis[1-(4-carboxyphenyl)-3-methyl-2-pyrazolin-5-one-4]. Dye II was 4-(4-diemthylaminobenzylidene)-1-(4-carboxyphenyl)-3-methyl-2-pyrazolin-5-one.

Control Film C

This film was identical to Control Film A, except that the following dyes were added to each Protective Overcoat:

| | |
|---|---|
| Dye I | (0.48) |
| Dye II | (0.16) |

Example Film D

This film was identical to Control Film A, except that Dyes I and II were added each Protective Overcoat and each Emulsion Layer.

Protective Overcoat:

| | |
|---|---|
| Dye I | (0.48) |
| Dye II | (0.16) |

Emulsion Layer:

| | |
|---|---|
| Dye I | (0.16) |
| Dye II | (0.11) |

The combination of Dyes I and II increased the optical density of the film prior to processing to greater than 3.0 over the spectral region of from 320 to 520 nm.

Exposure and Processing

Each of the films were identically exposed to X-radiation through a stepped density test object and processed through the following cycle:

Development 30 seconds at °C.;

Fixing 30 seconds at °C.;

Washing 20 seconds at °C.

A Kodak Prostar™ processor was employed.

The following developer was employed:

Developer A

| Component | grams/Liter |
|---|---|
| Hydroquinone | 32.0 |
| 4-Hydroxymethyl-4-methyl-1-phenyl-3-pyrazolidinone | 6.0 |
| Potassium bromide | 2.25 |
| 5-Methylbenzotriazole | 0.125 |
| Sodium sulfite | 160.0 |
| Water to 1 Liter | |
| pH | 10.35 |

The following fixer was employed:

Fixer A

| Component | grams/Liter |
|---|---|
| Potassium hydroxide | 3.2 |
| Glacial acetic acid | 9.6 |
| Ammonium thiosulfate | 100.0 |
| Ammonium sulfite | 7.1 |
| Sodium tetraborate pentahydrate | 4.4 |
| Tartaric acid | 3.0 |
| Sodium metasulfite | 6.6 |
| Aluminum sulfate | 3.3 |
| Water to 1 Liter | |
| pH | 4.9 |

Handling Between Exposure and Processing and Sensitometric Impact

Samples of each of the films were exposed for varied intervals between exposure and processing to either conventional safelight, in current use by dentists, or room light. The results are summarized in Table I. Speed was measured at a density of 0.85 above minimum density (Dmin) and is reported in relative log speed units, where an increase of 30 units indicates a doubling of speed.

TABLE I

| Film | Lighting | Seconds | Fog | Speed | Dmax |
|---|---|---|---|---|---|
| A | safelight | 60 | 0.19 | 228 | 5.1 |
| A | roomlight | 15 | 5.1 | — | 5.1 |
| A | roomlight | 30 | 5.1 | — | 5.1 |
| B | safelight | 60 | 0.20 | 224 | 4.8 |
| B | roomlight | 15 | 4.8 | — | 4.8 |
| B | roomlight | 30 | 4.8 | — | 4.8 |
| C | safelight | 60 | 0.20 | 226 | 4.9 |
| C | roomlight | 15 | 0.45 | 229 | 4.9 |
| C | roomlight | 30 | 0.56 | 224 | 4.9 |
| C | roomlight | 45 | 0.77 | 218 | 4.9 |
| C | roomlight | 60 | 1.20 | 228 | 4.9 |
| D | safelight | 60 | 0.20 | 230 | 4.6 |
| D | roomlight | 15 | 0.22 | 230 | 4.6 |
| D | roomlight | 30 | 0.31 | 236 | 4.7 |
| D | roomlight | 45 | 0.28 | 233 | 4.8 |
| D | roomlight | 60 | 0.30 | 233 | 4.8 |

The Seconds column in Table I shows the interval of film chip light exposure. From Table I, it is apparent that all of the direct dental films exhibited low minimum densities (fog) when handled under safelight in the interval between exposure and processing (comparable to handling while removing from an exposed film chip from an opaque package). The low minimum densities of the films processed after safelight handling provided direct evidence that Dyes I and II were decolorized during processing.

Control Film A, with no filter dyes added, reached a minimum density equal to its maximum density at even the shortest exposure to room lighting.

The addition of absorbing Dyes I and II to the Emulsion Layers (Control Film B) was ineffective in providing room-light handling capability, as minimum density rose to equal maximum density with only 15 seconds exposure to room-light.

The addition of absorbing Dyes I and II to the Protective Overcoats (Control Film C) provided some protection against increasing minimum density, but the resulting fog levels were still too high to be acceptable.

Only the addition of absorbing Dyes I and II to the Protective Overcoats and Emulsion Layers (Example Film D) achieved a full 60 seconds handling time without a significant increase in fog.

A minute is a sufficient time interval to unload a dental chip from its opaque package and to place the chip in a light tight processor. Thus, a dentist can retrieve a dental film chip in its opaque package from a patient's mouth, strip the chip from the package, and insert the chip in a light tight processor without leaving the patient's side. Within a minute the dentist can retrieve from the processor a tooth image for inspection, allowing patient interaction to continue uninterrupted.

The invention has been described in detail with particular reference to preferred embodiments thereof, but it will be understood that variations and modifications can be effected within the spirit and scope of the invention.

What is claimed is:

1. A direct X-ray dental film comprised of a transparent film support having first and second major faces and, coated on the major faces, processing solution permeable hydrophilic colloid layer units including emulsion layers comprised of silver halide grains containing less than 3 mole percent iodide, based on silver, and protective layers coated over the emulsion layers,

WHEREIN a desensitizer is adsorbed to the silver halide grains to reduce their sensitivity to light without significantly reducing their sensitivity to X-radiation and the emulsion and protective layers contain dye particles which can be decolorized during processing, the dye particles being present in an amount sufficient to provide an average density of greater than 3.0 over a spectral range of above 320 nm over which the silver halide exhibits an absorption coefficient of at least 0.5 $cm^{-1}$, from 15 to 40 percent of the dye particles being present in the emulsion layers and from 60 to 85 percent of the dye particles being present in the protective layers.

2. A direct X-ray dental film according to claim 1 wherein the emulsion layers contain a silver bromide emulsion.

3. A direct X-ray dental film according to claim 1 wherein the transparent film support is blue tinted.

4. A direct X-ray dental film according to claim 1 wherein the emulsion layers contain a tabular grain emulsion having an average grain equivalent circular diameter of less than than 5.0 $\mu$m, with tabular grains having an average thickness of less than 0.3 $\mu$m accounting for greater than 50 percent of total grain projected area and having an average aspect ratio of at least 5.

5. A direct X-ray dental film according to claim 1 wherein the protective and emulsion layers contain a gelatin vehicle.

6. A direct X-ray dental film according to claim 1 wherein the dye particles satisfy the formula:

$$D\text{-}[(A)_y\text{-}X_n]_m$$

wherein

A is an aromatic ring bounded directly to D;

D is a dye chromophore forming moiety, which must include an aromatic ring when y is zero;

m is 1 or 2;

n is 1 to 3;

X is a substituent containing an ionizable proton, either on A or on an aromatic ring portion of D, having a pKa of 4 to 11 in an equal volume mixture of ethanol and water; and y is 0 to 4.

7. A direct X-ray dental film according to claim 6 wherein D includes a pyrazolin-5-one nucleus and y is 0.

8. A direct X-ray dental film according to claim 7 wherein the particulate dye is an oxonol dye containing two pyrazolin-5-one nuclei joined by a methine linkage to the 2 ring position of the nuclei.

* * * * *